US006236147B1

(12) United States Patent
Capobianco

(10) Patent No.: US 6,236,147 B1
(45) Date of Patent: May 22, 2001

(54) ARC LAMP

(75) Inventor: Robert A. Capobianco, Peabody, MA (US)

(73) Assignee: PerkinElmer, Inc., Wellesley, MA (US)

( * ) Notice: Subject to any disclaimer, the term of this patent is extended or adjusted under 35 U.S.C. 154(b) by 0 days.

(21) Appl. No.: 09/271,048

(22) Filed: Mar. 1, 1999

Related U.S. Application Data

(63) Continuation-in-part of application No. 09/000,704, filed on Dec. 30, 1997.

(51) Int. Cl.[7] ..... H01J 61/40

(52) U.S. Cl. ..... 313/113; 313/573; 313/39; 313/110

(58) Field of Search ..... 313/113, 110, 313/634, 635, 573, 115, 116, 117, 46, 44, 39, 35

(56) References Cited

U.S. PATENT DOCUMENTS

| | | | |
|---|---|---|---|
| 3,731,133 | 5/1973 | McRae et al. | 313/113 |
| 4,599,540 | 7/1986 | Roberts | 313/634 |
| 4,633,128 | 12/1986 | Roberts et al. | 313/113 |
| 5,399,931 | 3/1995 | Roberts | 313/46 |
| 5,721,465 | 2/1998 | Roberts | 313/46 |

OTHER PUBLICATIONS

Capobianco, R.A., "Xenon: The Full Spectrum vs. Deuterium Plus Tungsten", EG&G Optoelectronics 6/97.

Capobianco, R.A., "Optical Coupling of Flashlamps and Fiber Optics", EG&G Optoelectronics 6/97.

Capobianco, R.A., "High–Stabilityt Pulsed Light Systems", EG&G Optoelectronics 6/97.

Advertisement 1100 Series High Stability Short Arc Xenon Flashlamps, EG&G Optoelectronics 2/94.

Advertisement, 1100 Series FlashPacs, EG&G Optoelectronics, 1/97.

Advertisement, 1100 Series Lite–Pac Trigger Modules, EG&G Optoelectronics 2/94.

Advertisement, 1100 Series FX–1160, High Output Short Arc Xenon Flashlamp With Internal Reflector, EG&G Optoelectronics 10/96.

Advertisement, LabPac PS 1200 Laboratory Flashlamp Power Supply, EG&G Optoelectronics 1/97.

Advertisement, 1100 Series Power Supplies, EG&G Optoelectronics 2/94.

Advertisement, 1100 Series Short Arc Flashlamps, Trigger Modules and Power Supplies, EG&G Optoelectronics 10/1997.

*Primary Examiner*—Nimeshkumar D. Patel
*Assistant Examiner*—Joseph Williams
(74) *Attorney, Agent, or Firm*—Kirk Teska Iandiorio & Teska

(57) ABSTRACT

An arc lamp with a housing including a base, an inert gas in the housing, a pair of spaced electrodes in the housing for establishing an arc in the gas to generate a radiation output, a window area on the housing for transmitting forward radiation generated by the arc, and an absorbing medium on the opposite side of the electrodes from the window for preventing backscatter radiation from the arc from passing through the arc and out of the window.

18 Claims, 5 Drawing Sheets

ARC LAMP

RELATED INVENTIONS

This application is a continuation in part of application Ser. No. 09/000,704 filed on Dec. 30, 1997 entitled IMPROVED ARC LAMP.

FIELD OF INVENTION

This invention relates to an arc lamp, and more particularly to such an arc lamp pulsed or continuous having an absorbing medium and/or a backscatter deflector.

BACKGROUND OF INVENTION

Conventional arc lamps, pulsed or continuous, provide a high energy density, high intensity, sharply defined source which is desirable in a number of applications. The high energy density and high intensity make arc lamp sources desirable in spectroscopy where the chemical sensitivity is a direct function of the energy density at the target sample. The high energy density and high intensity are also useful in miniaturization applications such as in fiber optic light transmission for endoscopic uses and generally in photographic illumination applications where a high intensity minute controlled source of illumination is essential. One shortcoming of such lamps is that more than half of the radiation generated is lost because of backscattering of the rearward directed radiation within the arc lamp. Worse still, that lost, backscattered rearward radiation increases the heating of the lamp and contributes to optical noise that interferes with the output beam. In some designs paraboloidal and ellipsoidal internal reflectors have been used to collect and control more of the available arc radiation but because of electrode orientation can cause a void or black hole in the direct radiation, and each of them inadvertently increases magnification at the target which in most applications is undesirable.

SUMMARY OF INVENTION

It is therefore an object of this invention to provide an improved arc lamp of the continuous or pulsed type.

It is a further object of this invention to provide such an improved arc lamp which can substantially increase radiation output without increase in power input.

It is a further object of this invention to provide such an improved arc lamp which can substantially reduce power while maintaining radiation output.

It is a further object of this invention to provide such an improved arc lamp which conserves energy.

It is a further object of this invention to provide such an improved arc lamp which recaptures radiation emitted rearwardly away from the window and redirects through the window with the forward transmitted radiation.

It is a further object of this invention to provide such an improved arc lamp which dramatically reduces optical noise generated by the backscattered rearward directed radiation.

It is a further object of this invention to provide such an improved arc lamp which substantially reduces the heat loss in the arc lamp.

It is a further object of this invention to provide such an improved arc lamp which generates a high energy density, high intensity radiation beam without voids or holes.

It is a further object of this invention to provide such an improved arc lamp which imposes no unwanted magnification.

This invention results from the realization that the optical noise generated in a conventional arc lamp can be reduced by depositing a convex black absorbing medium on the lamp base and that any backscatter radiation not absorbed by the absorbing medium can be preventing from exiting the lamp by an optical deflector positioned between the base and the electrodes of the lamp.

This invention features an arc lamp comprising a housing including a base, an inert gas in the housing, a pair of spaced electrodes in the housing for establishing an arc in the gas to generate a radiation output, a window area on the housing for transmitting forward radiation generated by the arc, and an absorbing medium on the opposite side of the electrodes from the window for preventing backscatter radiation from the arc from passing through the arc and out of the window.

The absorbing medium is preferably located on the housing base and black in color. The absorbing medium may be convex, concave, or flat in shape. There may also be a deflector between the electrodes and the absorbing medium. The deflector has one or even two rearward deflective surfaces. The absorbing medium typically has a roughened top surface to assist in diffusion. The housing and base can be standard TO-5 components.

The arc lamp of this invention includes a housing with a base, an inert gas in the housing, a pair of spaced electrodes in the housing for establishing an arc in the gap to generate a radiation output, a window area on the housing for transmitting forward radiation generated by the arc, and noise reduction means for preventing backscatter radiation from the arc from passing through the arc and out of the window.

The noise reduction means may include or is an absorbing medium on the housing base. The absorbing medium is preferably black or dark in color, convex or concave, and has a roughened surface.

Alternatively, the noise reduction means includes or is a deflector on the opposite side of the electrodes from the window. Or, the noise reduction means includes both an absorbing medium on the opposite side of the electrode from the window and a deflector disposed between the electrodes and the absorbing medium. Other embodiments, however are possible.

DISCLOSURE OF PREFERRED EMBODIMENT

Other objects, features and advantages will occur to those skilled in the art from the following description of a preferred embodiment and the accompanying drawings, in which.

Figure 1:
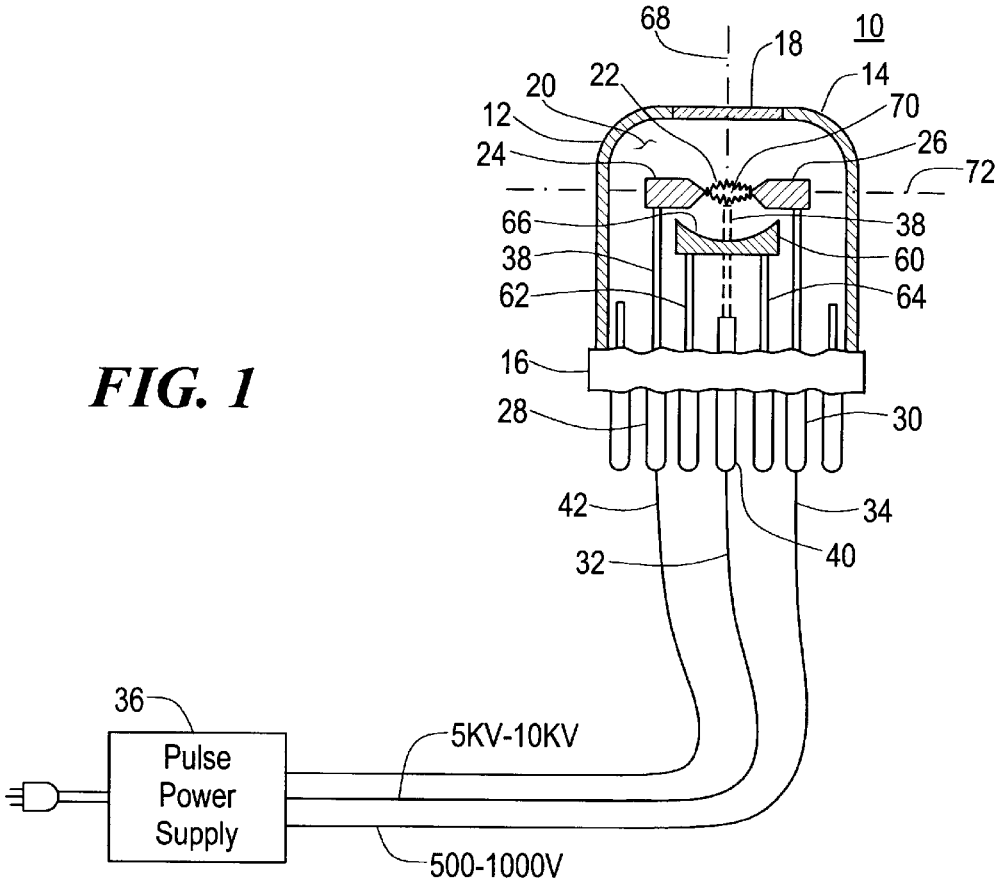
FIG. 1 is a schematic diagram of an arc lamp with pulsed power supply for operation as a pulsed arc lamp employing an internal spherical reflector in accordance with this invention.

There is shown in FIG. 1 an arc lamp 10 according to this invention having a housing 12 comprised of a cover 14 and a pin press 16. Cover 14 may be made of glass or of metal such as Kovar and has a transparent window 18 that can be made of glass such as borosilicate, UV quartz or fused silicon, through which the radiation generated can be passed. Cover 14 contains an inert gas, typically argon, krypton or xenon, 20 in which a plasma arc 22 is struck between electrodes 24 and 26. Electrodes 24 and 26 are mounted on pins 28 and 30 which are electrically connected via wires 32 and 34 to pulsed power supply 36 which supplies a nominal voltage of 300–3000 volts on lines 32 and 34 to sustain an existing arc. Trigger electrode 38 proximate to the main electrodes 24 and 26 is mounted on pin 40 electrically connected through conductor 42 to pulse power supply 36 which periodically supplies a trigger pulse of 5–10 KV to periodically trigger the arc. The pulsed operation is conducted by periodic discharge of the voltage on the main electrodes 24, 26 so that the arc is extinguished and then re-triggering the arc repeatedly when the main voltage is restored. Although pins 28, 30 and 40 are shown directly connected to wires 32, 34 and 42, typically those pins engage in holes in a socket where the electrical connection is made, but the socket has been eliminated here for simplicity of illustration.

Figure 2:
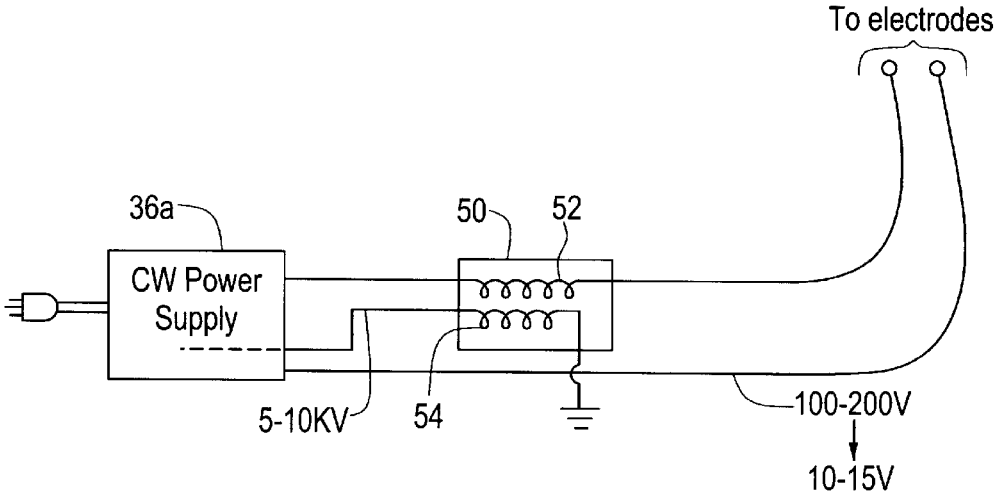
FIG. 2 is a schematic diagrammatic view of a continuous power supply for operating the arc lamp of FIG. 1 as a continuous arc lamp.

Although the arc lamp 10 has been explained thus far as a pulsed arc lamp, this is not a necessary limitation of the invention; it may be a continuous wave arc lamp as well. In that case, the pulsed power supply 36 is replaced by a continuous wave power supply 36*a*, FIG. 2, which provides power to electrodes 24 and 26 through wires 32*a* and 34*a*.

In that case arc 22 is triggered or ignited by igniter 50 which may include a coil 52 in series with conductor 32*a* inductively coupled with a second coil 54 grounded at one end and connected to power supply 36*a* at the other, whereby an induced nominal voltage of 5–10 K is impressed on coil 54 by power supply 36*a* and the collapsing field induces a voltage of 5–10 KV in coil 52 which momentarily propagates through conductor 32*a*, appears across electrodes 24 and 26 and strikes the arc, after which the continuous supply of 100–200 volts on lines 32*a* and 34*a* sustains the arc. Once the arc is struck and fully operational the voltage across it typically drops to 10–20 volts.

In either operation, regardless of whether arc lamp 10 is operated as a pulsed or continuous wave arc, a spherical mirror 60, FIG. 1, is provided. Mirror 60 is supported, for example, on two unconnected pins 62 and 64 so that the spherical surface 66 is on the opposite side of arc 22 from window 18 and the optical axis 68 of mirror 60 passes directly through arc 22 and the geometric center 70 of spherical surface 66 is in or about arc 22 on axis 68. As shown, electrodes 24 and 26 are aligned on axis 72 transverse to the optical axis 68 which extends through mirror 60 and window 18, but it is not necessary that they be aligned. The use of the spherical mirror in this position provides a number of advantages.

Figure 3:
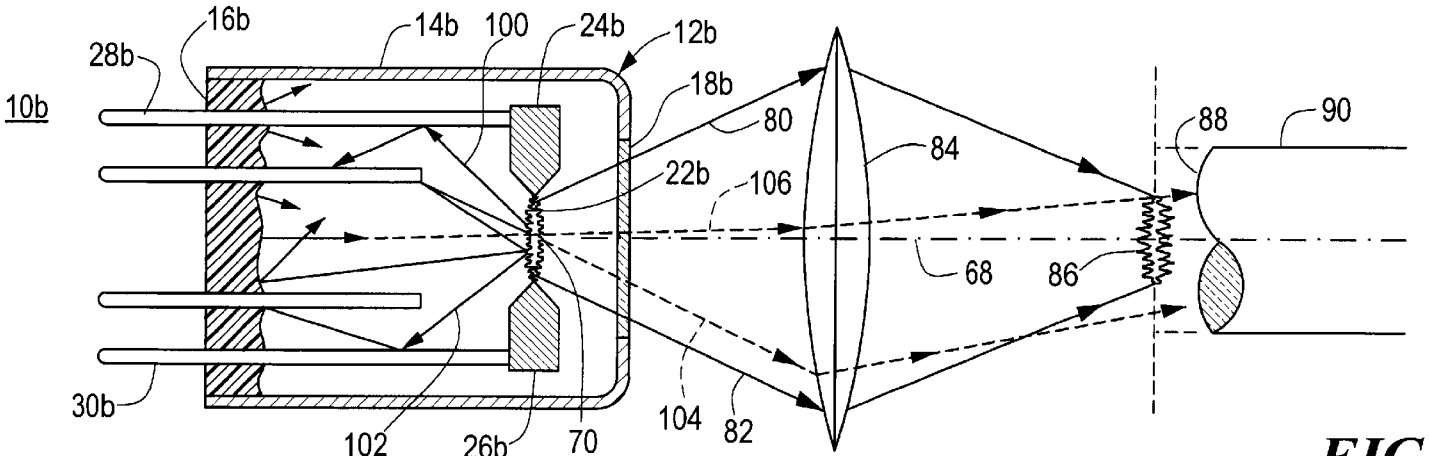
FIG. 3 is a ray diagram of a prior art arc lamp without the internal spherical reflector of this invention showing loss of rearwardly directed radiation and creation of optical noise.

As shown in the prior art device, arc lamp 10*b*, FIG. 3, emits forward transmitted light indicated by rays 80, 82 which are transmitted through window 18*b* and captured by lens 84 to produce the image 86 of arc 22*b* at a target plane such as the input aperture 88 of the fiber optic element 90. However, in this prior art arc lamp, fully half of the light escapes rearwardly as indicated by rays 100, 102 from arc 22*b* so that this light, roughly half of the light output energy, is lost to the system, making it highly inefficient. In addition, this radiation as indicated by rays 100 and 102, bounces around or backscatters off the pins and the surface of pin press 16*b* and some of that backscattered radiation passes through plasma arc 22*b* which is transparent and, as shown by rays 104 and 106, propagates through window 18*b* and lens 84. But it is not focussed at the site of the image 86 of the arc. Instead it is scattered about and causes a substantial amount of optical noise.

Figure 4:
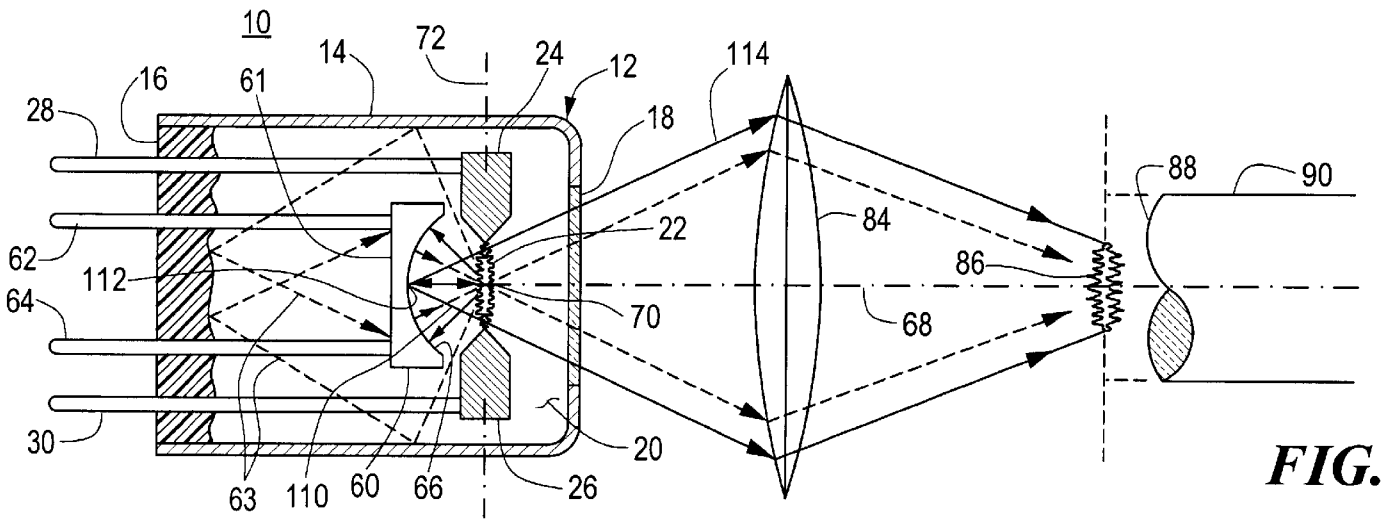
FIG. 4 is a ray diagram similar to FIG. 3 of an arc lamp with the internal spherical reflector of this invention showing the redirecting of rearwardly directed radiation and elimination of optical noise.

In accordance with this invention spherical mirror 60, FIG. 4 with its spherical surface 66 on the opposite side of arc 22 from window 18, captures the rearward exiting rays and redirects them through the transparent arc 22 and mirror 18 so that they add to the forward transmitted rays and are combined to focus at the same site of the image 86 of arc 22. For example, ray 110 traveling backwards from the edge of arc 22 proximate electrode 26 strikes mirror surface 66 at point 112 and then is reflected out as ray 114 to lens 84. Any radiation emanating from near the center 70 of spherical surface 66 in arc 22 is reflected back through that center 70 and is also collected by lens 84, thus making a small, sharp focus of the image at 86 well within the aperture 88 of fiber optic element 90. Thus spherical mirror 60 not only approximately doubles the light output for the same power, or conversely can provide the same light output for roughly half the power, but it also eliminates or at least dramatically reduces the optical noise that was previously present due to the backscattering of the rearwardly directed radiation. Any small amount of radiation that might escape past mirror 60 to the area behind it would be blocked by the deflection surface 61 on its rearward end as depicted by rays 63.

Although the embodiment illustrated thus far uses a combination of a spherical mirror 60 with a deflection surface 61 on its rearward end, this is not a necessary limitation of the invention as the use of a deflection surface above can achieve significantly improved efficiency. For example, a conical deflector 140, FIG. 5, can be provided on mount 141 with a forward deflector surface 142 for receiving and redirecting backscattered rays 144, 146, 148 so that they strike the rearward deflector surface 150 and are prevented from propagating through the arc 22*a* and out window 18*c*. Although forward deflector surface 142 is shown conical and rearward deflector surface 150 is flat, these are not necessary limitations of the invention as the shape will be determined by particular lamp dimensions and configuration to ensure against rearward radiation rebounding back through window 18*c*. Deflector 140 is preferably black to absorb most (typically 95%) of the incident radiation and specular to prevent diffuse emanation from the deflector.

Figure 6:
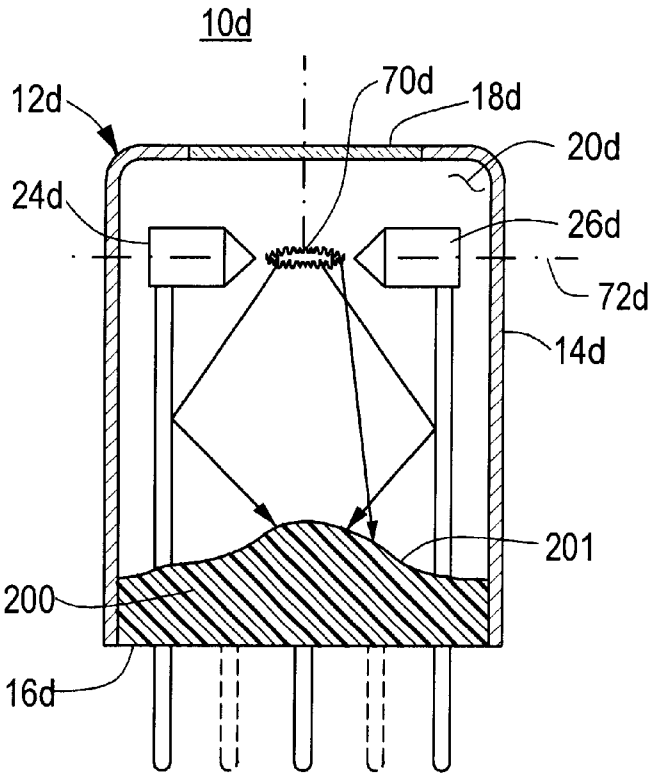
FIG. 6 is a view of another embodiment of the arc lamp of the subject invention including a noise reducing black convex absorbing medium deposited on the base of the lamp.
Figure 5:
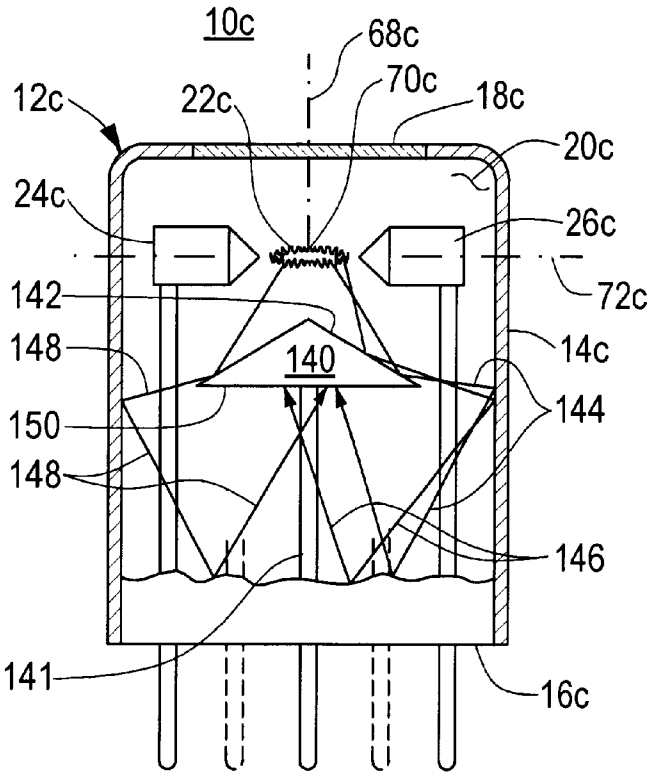
FIG. 5 is a view of the arc lamp of FIG. 1 with a deflector only and no spherical mirror.

The use of deflector 140, FIG. 5, is especially useful in miniture flash lamps in accordance with this invention. In one example, lamp 10*d*, FIG. 6 is 0.3 inches in diameter and 0.4 inches tall. Housing cover 14*d* is a standard transistor "TO-5" can and housing base 16*d* is a "TO5" base. Window 18*d* is sapphire or a ultraviolet transmissive glass material. A black absorbing medium 200 is deposited to form a convex shape on base 16*d* to prevent backscatter radiation from arc 70*d* passing through the arc and out of window 18*d*. Absorbing medium 200 may be a dark colored glass formed by molding glass frit material into the desired shape. Top surface 201 of absorbing medium 200 may be rendered diffuse by light sandblasting or by making the mold cavity surface rough.

Figure 7:
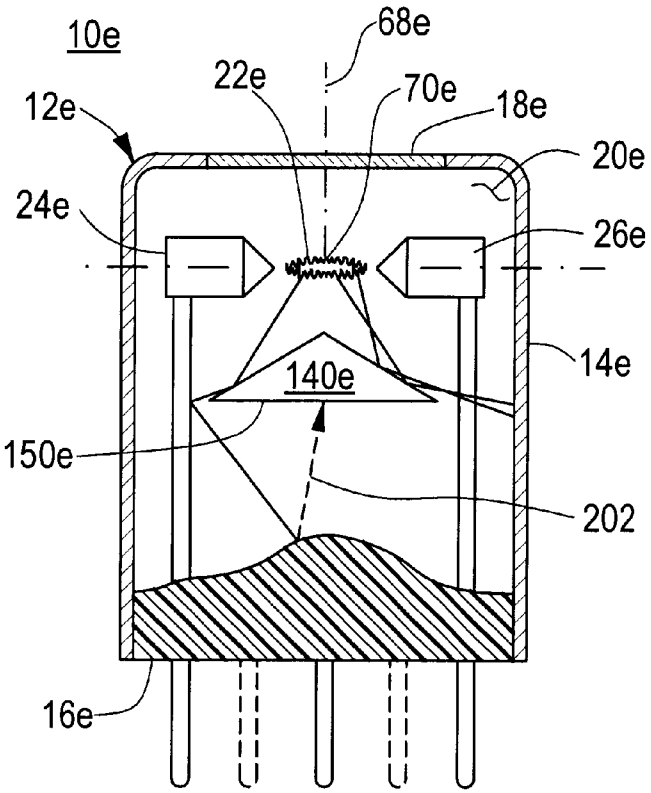
FIG. 7 is a view of another embodiment of the arc lamp of the subject invention including both an absorbing medium deposited on the base of the arc lamp and a deflector disposed between the base of the lamp and the electrodes of the lamp.

Absorbing medium 200 absorbs most (typically 95%) of the incident and specular radiation to prevent diffuse emanations. In FIG. 7, lamp 10*e* includes deflector 140*e* which has rearward black deflective surface 150*e* to absorb or redirect any remaining radiation as shown by vector 202.

Figure 8:
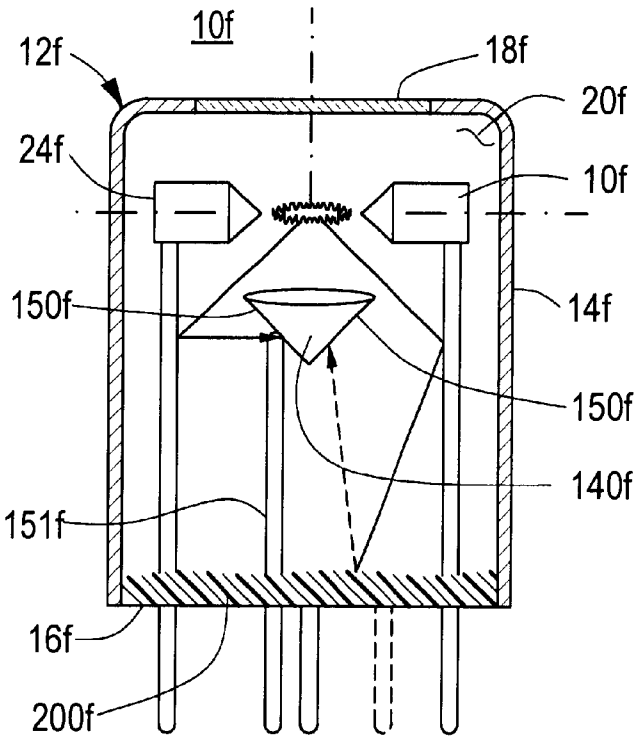
FIG. 8 is a view of still another embodiment of the arc lamp of the subject invention in which the absorbing medium is simply a black compound deposited on the base of the lamp and the deflector includes two rear deflective surfaces.
Figure 9:
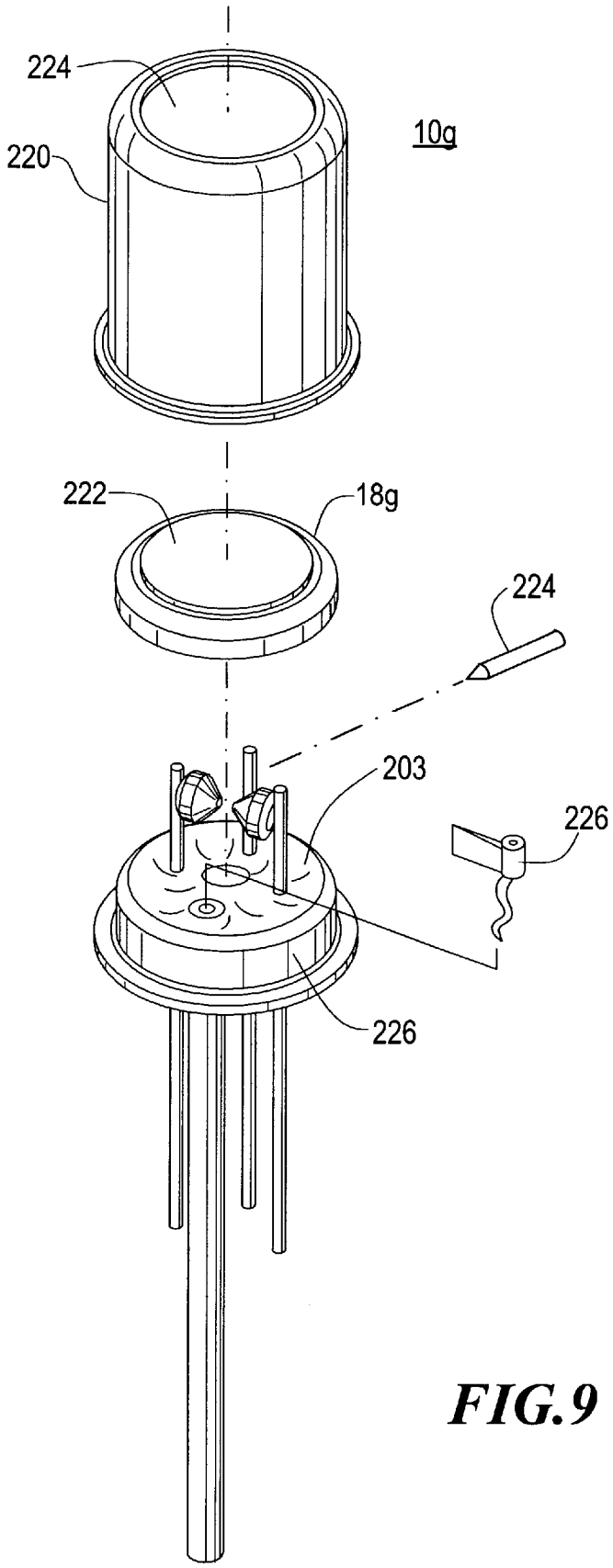
FIG. 9 is an exploded view of still another embodiment of the subject invention.

Lamp 10*f*, FIG. 8 includes hollow conical deflector 140*f* and absorbing medium 200*f*, namely darkened glass or ceramic material deposited on the upper surface of standard TO-5 base 16*f*. Standard TO bases typically include unsuitable shiny metallic surfaces. Dual rear deflective surfaces 150*f* of deflector 140*f* are black anodized or made of black material to absorb any radiation not absorbed by absorbing medium 200*f*. Deflector 150*f* is spot welded to pin 151*f* as shown. Deflector 150*f* may be black metallized ceramic, black anodized stainless steel, or Kovar. Care should be taken in choosing the material of the absorbing medium and the optional deflector to prevent outgassing within the vacuum environment of housing 12. In FIG. 9, absorbing medium 203 of lamp 10*g* is concave in shape and made of black glass material. FIG. 9 also shows window or lens insert 18*g* which fits inside TO-5 can 220 such that window or lens surface 222 fills orifice 224. FIG. 9 also shows probe wire 224 and sparker 226, components normally associated with arc lamps. These components are now shown in the other drawings for clarity. TO-5 can 220 is secured to TO-5 header base 226 in the final assembly. The result is a very small size inexpensive plasma-arc lamp which can be mass produced.

Therefore, lamps 10*d*, FIG. 6; 10*e*, FIG. 7; and 10*f*, FIG. 8 and 10*g* FIG. 9 include noise reduction means such as convex, black absorbing medium 200, FIG. 6 on base 16*d*; the combination of an absorbing medium and deflector 140*e*, FIG. 7; absorbing medium 200*f*, FIG. 8 and the deflector 140*f* with two rear deflective surfaces; concave absorbing medium 203, FIG. 9; or any combination of these configurations.

Each such lamp features a dramatic reduction in optical noise because backscatter radiation is deflected and/or absorbed, a feature especially important when the lamps are miniaturized as discussed above.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. An arc lamp comprising:

a housing including a base;

an inert gas in said housing;

a pair of spaced electrodes in said housing for establishing an arc in said gas to generate a radiation output;

a window area on the housing for transmitting forward radiation generated by the arc; and an absorbing medium on the opposite side of the electrodes from the window for preventing backscatter radiation from the arc from passing through said arc and out of said window.

2. The arc lamp of claim 1 in which said absorbing medium is on the housing base.

3. The arc lamp of claim 2 in which the absorbing medium is black.

4. The arc lamp of claim 1 in which the absorbing medium is convex in shape.

5. The arc lamp of claim 1 in which the absorbing medium is concave in shape.

6. The arc lamp of claim 1 further including a deflector between the electrodes and the absorbing medium.

7. The arc lamp of clam 6 in which the deflector has one rearward deflective surface.

8. The arc lamp of claim 6 in which the deflector has two rearward deflective surface.

9. The arc lamp of claim 1 in which the absorbing medium has a roughened surface to assist in diffusion.

10. The arc lamp of claim 1 in which the housing and base are TO-5 components.

11. An arc lamp comprising:

a housing including a base;

an inert gas in said housing;

a pair of spaced electrodes in said housing for establishing an arc in the gap to generate a radiation output;

a window area on the housing for transmitting forward radiation generated by the arc; and noise reduction means for preventing backscatter radiation from the arc from passing through the arc and out of the window.

12. The arc lamp of claim 11 in which said noise reduction means includes an absorbing medium on the housing base.

13. The arc lamp of claim 12 in which the absorbing medium is black.

14. The arc lamp of claim 11 in which said noise reduction means includes a convex shaped absorbing medium.

15. The arc lamp of claim 11 in which said noise reduction means includes a concave shaped absorbing medium.

16. The arc lamp of claim 12 in which said absorbing medium has a roughened surface to assist in diffusion.

17. The arc lamp of claim 11 in which the noise reduction means includes a deflector on the opposite side of the electrodes from the window.

18. The arc lamp of claim 11 in which the noise reduction means includes an absorbing medium on the opposite side of the electrode from the window and a deflector disposed between the electrodes and the absorbing medium.

* * * * *